US008695249B1

(12) United States Patent
Al Hasan

(10) Patent No.: US 8,695,249 B1
(45) Date of Patent: Apr. 15, 2014

(54) EXTERNAL ELEVATOR/ADVERTISING BOARD SYSTEM FOR BUILDINGS

(71) Applicant: Khaled Jafar Al Hasan, Al-Zahra (KW)

(72) Inventor: Khaled Jafar Al Hasan, Al-Zahra (KW)

( * ) Notice: Subject to any disclaimer, the term of this patent is extended or adjusted under 35 U.S.C. 154(b) by 0 days.

(21) Appl. No.: 13/961,862

(22) Filed: Aug. 7, 2013

(51) Int. Cl.
*G09F 7/00* (2006.01)

(52) U.S. Cl.
USPC ..... 40/601; 182/141; 182/82; 40/606.03; 40/606.01

(58) Field of Classification Search
USPC ..... 182/141, 82; 40/601, 606.03, 606.01
See application file for complete search history.

(56) References Cited

U.S. PATENT DOCUMENTS

| | | | | |
|---|---|---|---|---|
| 642,779 | A | 2/1900 | Bates | |
| 866,078 | A | 9/1907 | Sims | |
| 4,176,486 | A * | 12/1979 | Williams | 40/607.12 |
| 4,664,226 | A | 5/1987 | Centanne | |
| 4,887,694 | A | 12/1989 | Ho | |
| 5,159,993 | A | 11/1992 | St-Germain | |
| 5,161,641 | A * | 11/1992 | Nusbaum | 182/138 |
| 6,250,426 | B1 | 6/2001 | Lombard | |
| 7,000,344 | B2 * | 2/2006 | Furlan et al. | 40/601 |
| 7,281,607 | B1 * | 10/2007 | Kiraly | 182/82 |
| 2004/0194361 | A1 * | 10/2004 | Furlan et al. | 40/601 |
| 2005/0087393 | A1 | 4/2005 | Korchagin et al. | |
| 2006/0144639 | A1 | 7/2006 | Iacoviello, Jr. | |

FOREIGN PATENT DOCUMENTS

GB 2 099 789 A 12/1982

* cited by examiner

*Primary Examiner* — Shin Kim
(74) *Attorney, Agent, or Firm* — Richard C. Litman

(57) ABSTRACT

The external elevator/advertising board for buildings includes an elevator carriage riding on a track assembly on at least one side of a building. Each elevator carriage is defined by an elongate, open box frame having a control console mounted to a floor panel. A power assembly is operatively connected to the control console at the bottom of the elevator carriage. Operation of the console facilitates selective raising and lowering of the elevator carriage at select speeds along a side of the building to a select level for cleaning, maintenance, and emergency evacuation. A front panel of the box frame is disposed at an angle angled towards the ground. The front panel displays advertisements for maximum exposure to traffic around the building.

20 Claims, 5 Drawing Sheets

EXTERNAL ELEVATOR/ADVERTISING BOARD SYSTEM FOR BUILDINGS

BACKGROUND OF THE INVENTION

1. Field of the Invention

The present invention relates to building service devices, and particularly to an external elevator system for advertising and other services on a building providing potential advertising revenue and ease of maintenance and emergency services.

2. Description of the Related Art

The demands of business and residential space have led to widespread growth of high-rise buildings, especially in cities where real estate is at a premium both in terms of costs and space. Holding companies and the like usually manage these buildings, but in order to generate profit for the investors, several years of solvency must pass to collect enough revenue from the residents.

Part of the expenses for such buildings arises from maintenance and general care. Electric power, gas and water are some of the basic utilities that must be provided. In some instances, these expenses are recovered as part of the rent charged to the commercial and domestic residents, and in other instances, the responsibility lies solely with the residents. Some buildings also provide additional services such as round-the-clock security, gym and staff to handle these services as well as minor miscellaneous emergencies.

Another expense lies in maintaining the attractiveness of a building. It is a common trait and fact of human nature that buildings should have visual appeal in order to attract potential residents. Besides the architectural beauty, the buildings should at least be outwardly clean. Some, if not most, enhance their attractiveness with landscaping that complements the locale. Unlike typical residential homes, cleaning of high-rise buildings involves risky maneuvers from those who work outside the building to clean the windows and/or surfaces. These usually require cranes installed on the roof of a building with a work platform suspended from a side of the building. The work platform is usually raised or lowered by a pulley-wench mechanism, either manual or powered. This platform can be used both for cleaning and repairs. If favorable weather conditions exist, the suspended work platform is usually safe for the task. However, excessive winds and similar weather conditions pose too great of a risk for initiating or processing that endeavor. The fickle nature of weather can cause undesirable delays to scheduled cleaning thereby increase expenses.

Though much expense may be involved in maintaining such buildings, some have pursued other avenues to generate additional revenue. One such avenue involves advertising. Many businesses desire widespread public exposure, and much revenue can be garnered thereby for the interested businesses and the party facilitating the advertisement. High profile buildings or buildings located in high traffic areas are usually sought, but many lack the means to display advertisement for extended lengths of time. Some may be built with large media screens which may be ideal for the ever-changing vagaries of advertisements or have rooftop billboards. However, many are relegated to hanging banners which, while visible, requires special hardware or mountings that may not be suitable for prolonged use or exposure.

In addition to the above, much attention must be paid to emergency services or procedures within buildings. Most modern buildings already employ automatic fire extinguishers for fire emergencies and emergency evacuation routes which are limited to either stairs or outside fire escapes. While sufficient for most instances, there may be situations where escape routes are blocked by debris or rushing people, and fire escapes may not be sufficiently secure to handle the potential human traffic, especially in a panic situation. A potential escape lies through the windows, but that poses a fatal risk at increasing heights.

In light of the above, it would be a benefit in the art of building services to provide a means of displaying advertisements with additional utility for servicing a building. Thus, an external elevator/advertising board for buildings solving the aforementioned problems is desired.

SUMMARY OF THE INVENTION

The external elevator/advertising board for buildings includes an elevator carriage riding on a track assembly on at least one side of a building. Each elevator carriage is defined by an elongate, open box frame having a control console mounted to a floor panel. A power assembly is operatively connected to the control console at the bottom of the elevator carriage. Operation of the console facilitates selective raising and lowering of the elevator carriage at select speeds along a side of the building to a select level for cleaning, maintenance, and emergency evacuation. A front panel of the box frame is disposed at an angle angled towards the ground. The front panel displays advertisements for maximum exposure to traffic around the building.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
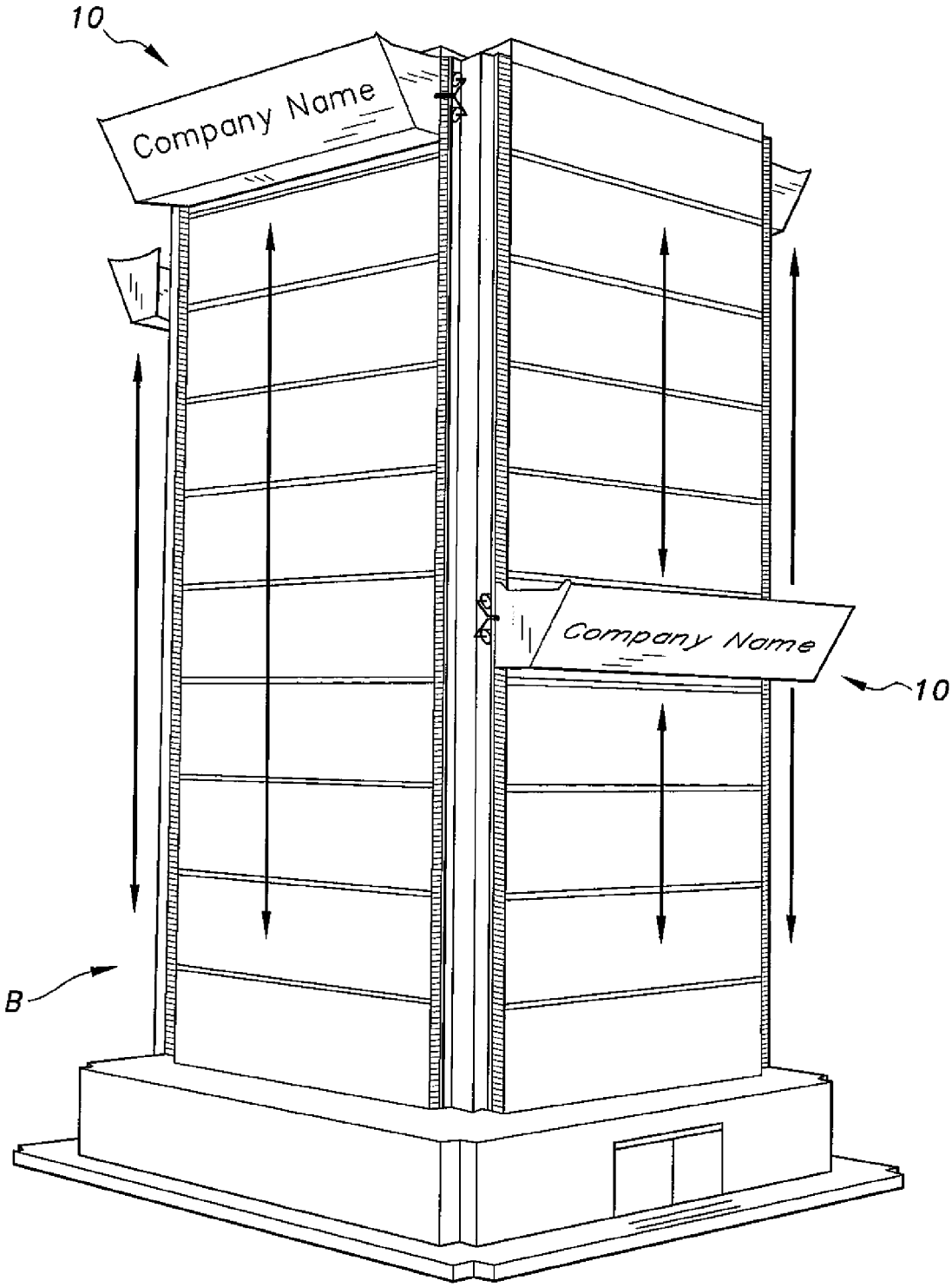
FIG. 1 is an environmental, perspective view of an external elevator/advertising board system for buildings according to the present invention.
Figure 2:
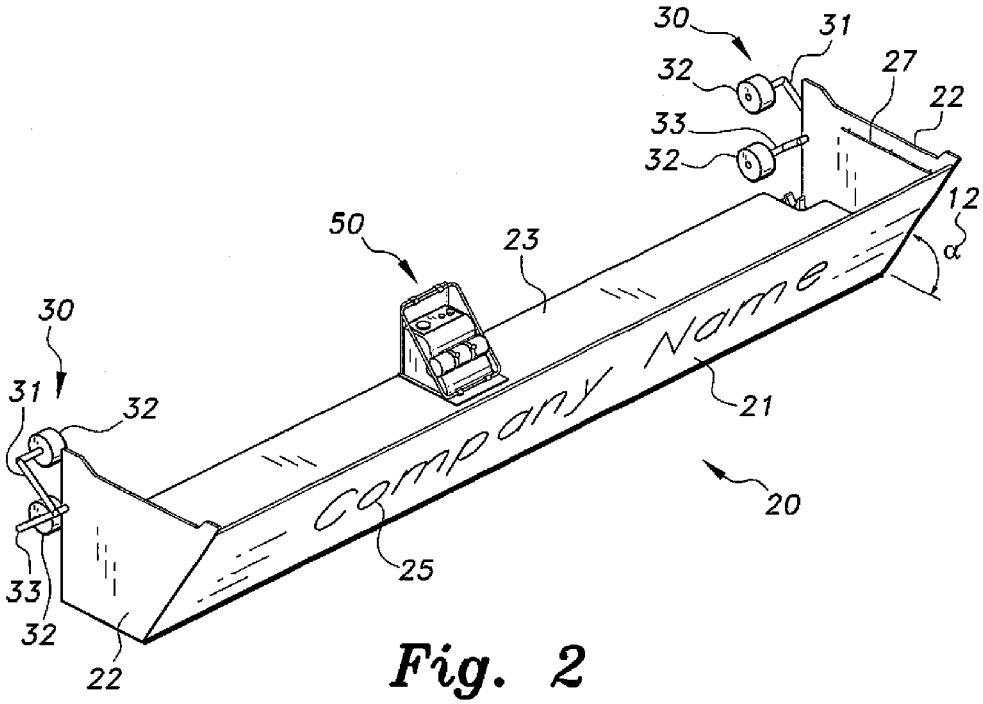
FIG. 2 is a front perspective view of the external elevator carriage for buildings shown in FIG. 1.

The external elevator/advertising board system for buildings, such as may include other structures, generally referred to by the reference number 10 in the drawings, provides convenient space for displaying advertisements and an elevator platform for maintenance and cleaning building facades as well as emergency escape. As best seen in FIGS. 1-4, the external elevator/advertising board system 10 includes a movable elevator carriage 20 riding on a track assembly 40 installed on the outside of a building B. Preferably, the track assembly 40 extends from the bottom to the top of the building permitting the elevator carriage 20 access to substantially all levels of the building B. For purposes of discussion, the exemplary embodiment shown in FIG. 1 shows the building B having a ground lobby floor and twelve floors or levels stacked upwardly from the lobby with the elevator carriage 20 reciprocally movable between the twelve floors. For a typical building B, all four side sides of the building can include the elevator carriage 20 and corresponding track assembly 40.

As best seen in FIGS. 2-5A, the elevator carriage 20 includes an elongate, substantially box-like frame preferably open at the top and one of the elongate sides. A power assembly 60 is preferably disposed at the bottom of the box frame which is selectively activated by a control console 50 in the box frame. The control console 50 facilitates selective raising or lowering of the elevator carriage 20 with respect to the building B, as well as other functions desired or required by the user. The box frame includes an elongate front panel 21, two polygonal side panels 22, an elongate bottom panel 24, and an elongate floor or deck panel 23 disposed above the bottom panel 24. The box frame is typically constructed from relatively lightweight, sturdy materials such as aluminum that can withstand the rigors of the exterior environment and the traffic of users. It is noted that other suitable materials such as wood, plastic, composites and combinations thereof can also be used exhibiting similar characteristics. The front panel 21 provides space for displaying desired advertisements 25 thereon such as a company name or any other words, symbols, and visual media construed as advertisement. The advertisements 25 can be provided in a variety of forms such as poster panels, engravings, spray painting, multimedia panels and the like. Alternatively, the advertisements 25 as used herein can also include other forms of indicia, such as emergency messages, public announcements and the like.

Each polygonal side panel 22 has one sloping side upon which is affixed or mounted one end of the front panel 21. This construction places the front panel 21 at an acute angle $\alpha$ (referenced by the reference number 12 in FIG. 2) with respect to the bottom panel 24. In use, the front panel 21 with the advertisement 25 thereon angles towards the ground so that maximum visual exposure to pedestrian and motorized traffic can be achieved. At elevated height, especially the maximum height, the advertisement 25 is also exposed to air traffic for buildings of sufficient height.

The floor panel 23 is preferably flat to maximize space for equipment and other miscellaneous material, passenger capacity and work. However, the floor panel 23 can be provided in various different forms as desired by the user. For example, integrated compartments can extend from the flat surface where equipment and other miscellany can be stored. Similar features can be disposed on the other panels mentioned above. The resultant structure can be used as seating. In a similar vein, any of the panels can include integrated seats that can be selectively stored to maximize space or removed from storage in times of use, e.g., a pivotable seat panel. At times, the elevator carriage 20 may need to be serviced and removed from the building B. In order to assist such a task, mounting hardware can be provided on the floor panel 23 and/or any of the other panels 21, 22, 24. Such mounting hardware can also be used or constructed to facilitate secure mounting of specialized maintenance and/or cleaning equipment.

For convenience and safety, the box frame can also include a hand rail 27 mounted to the inner side of at least one of the panels 21, 22. The hand rail 27 allows, inter alia, handholds for stabilizing one's standing or mounting points for personal safety harnesses.

In order to facilitate positioning of the elevator carriage 20 at select heights with respect to the building B, the external elevator/advertising board system 10 includes a track assembly 40 mounted on corresponding sides, such as at the corners, of the building B. The track assembly 40 is provided by elongate, L-shaped corner components having a pair of rails, including a first elongate rail 42 and a second elongate rail 44 disposed orthogonally or substantially orthogonally with respect to each other. This arrangement places the first rail 42 facing away from one side of the building B, while the second rail 44 faces away from an adjacent, perpendicular or substantially perpendicular side of the building B. The first rail 42 is associated with a first elevator carriage 20 on the one side of the building B, and the second rail 42 is associated with a second elevator carriage 20 on the adjacent side of the Building B. Each rail 42, 44 is constructed as a rack having a plurality of respective engageable teeth 43, 44.

The first rail 42 and the second rail 44 are connected to each other by an elongate, central base beam 41, the base beam 41 providing relative sturdiness for supporting the first and second rails 42, 44 and for mounting the track assembly 40 onto the building B. The leg of the base beam 41 extending towards the first rail 42 includes a first channel 46 formed thereon behind the rack of the first rail 42. Similarly, the leg of the base beam 41 extending towards the second rail 44 also includes a second channel 48 formed behind the rack of the second rail 44.

Figure 4:
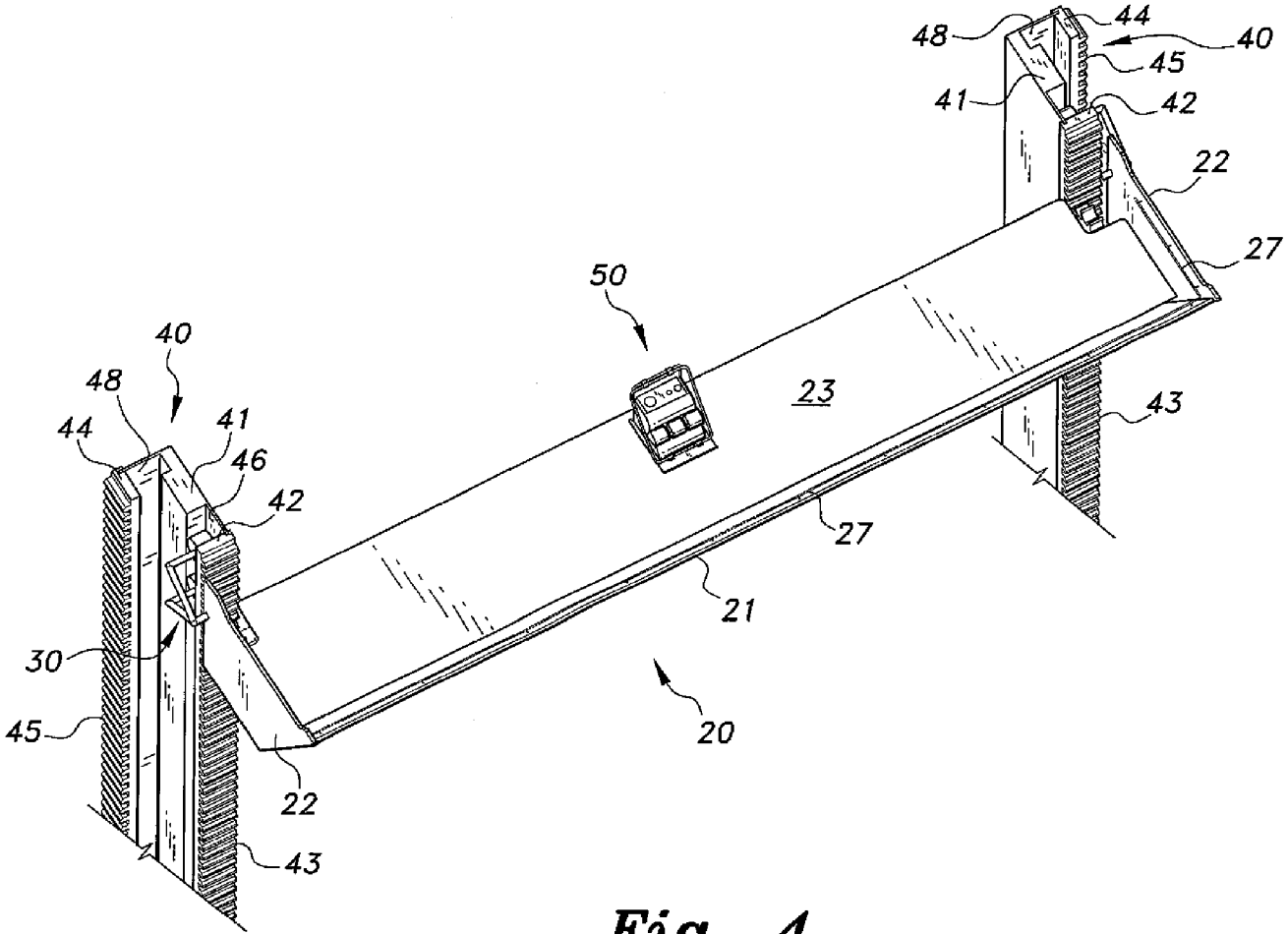
FIG. 4 is a top perspective view of the external elevator and the track assembly therefor for the external elevator/advertising system shown in FIG. 1.
Figure 5A:
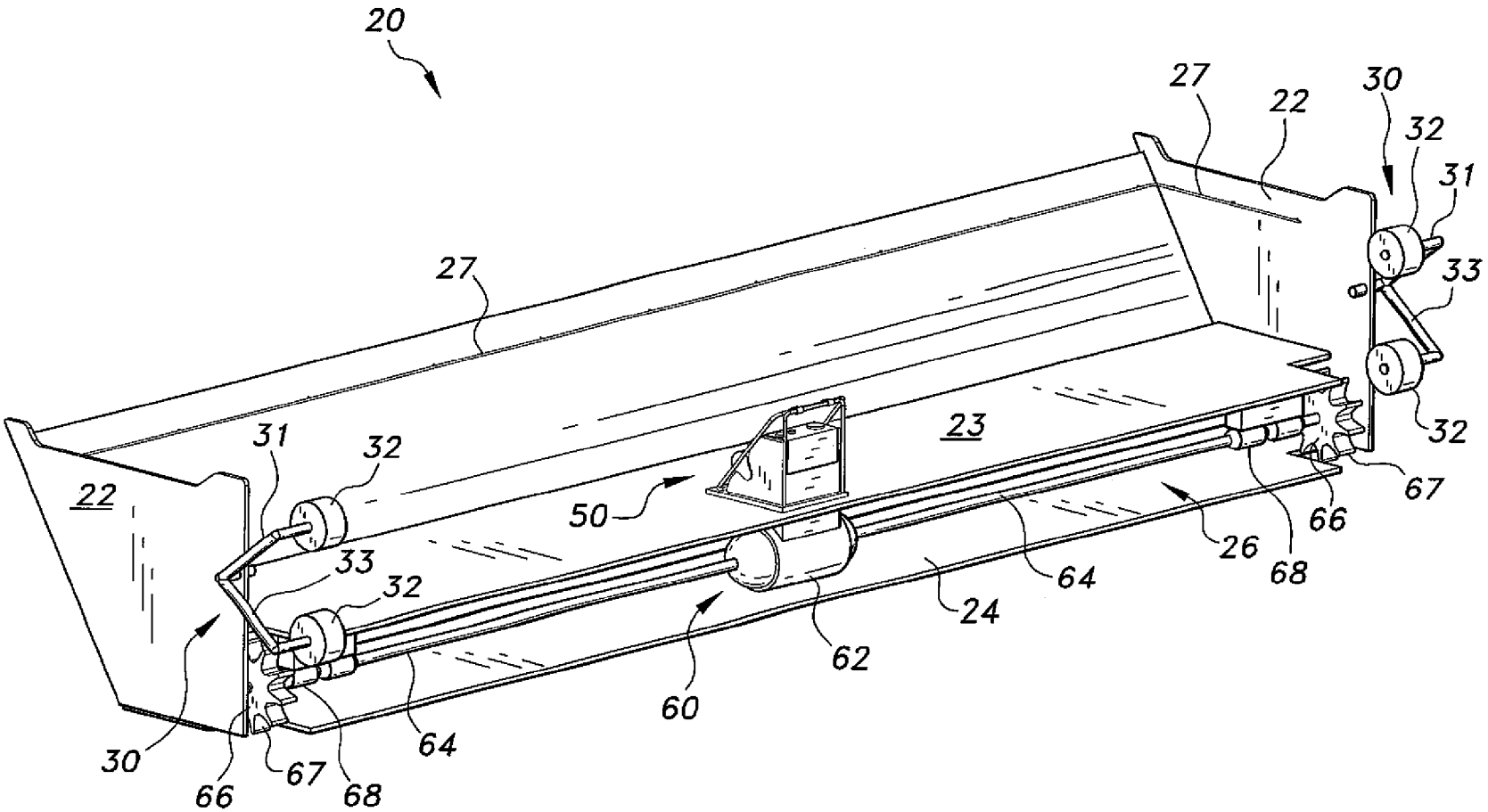
FIG. 5A is a back perspective view of the external elevator carriage shown in FIG. 2.

The first and second channels 46, 48 can passively support and assist in maintaining a relatively proper, operative orientation of the elevator carriage 20. As best seen in FIGS. 1, 4 and 5A, the elevator carriage 20 is movably mounted to a pair of spaced first rails 42 and reciprocates thereon by selective operation of the power assembly 60. The power assembly 60 is disposed near or adjacent to the bottom of the elevator carriage 20, the power assembly 60 being in a positive, operative engagement with the pair of first rails 42. For an elevator carriage 20 associated with a pair of the second rails 44, the power assembly 60 can be in a positive, operative engagement with the pair of second rails 44. The power assembly 60 can include a drive gear, such as drive pinions 66, which will be further described below, meshing with the racks of the first rails 42 or the racks of the second rails 44. However, such an arrangement alone may not prevent or counteract pivoting of the elevator carriage 20, such as with respect to the power assembly 60, because the elevator carriage 20 can act as a cantilevered structure with respect to the side of the building B.

Figure 3:
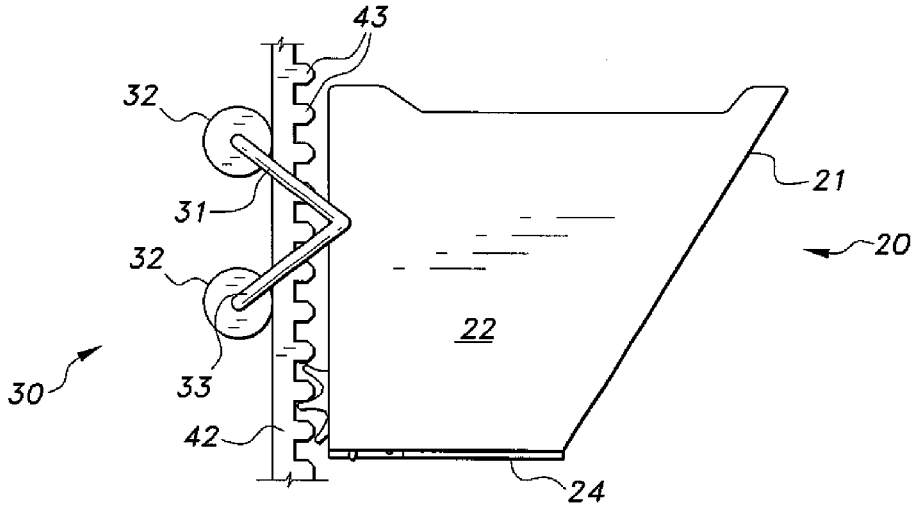
FIG. 3 is schematic side view of the external elevator carriage in riding engagement with a track assembly as shown in FIG. 1

In order to assist in maintaining a relatively proper, level orientation of the elevator carriage 20 on the rails 42 or 44, the elevator carriage 20 can include a brace roller assembly 30 pivotally mounted to a corresponding side panel 22 above the power assembly 60. Each brace roller assembly 30 can include an angled, open frame having a radiating first member 31 and a radiating second member 33 angularly spaced with respect to each other. A brace roller 32 is rotatably mounted to the distal end of each first and second member 31, 33. Each of the first and second members 31, 33 can, for example, be constructed as a robust, high-strength wire member bent into an L-shape, the proximal ends of the first and second members 31, 33 meeting at a common origin, i.e., the pivot axis, and extending out backward from the common origin at an angle with respect to each other. When assembled, each pair of brace rollers 32 engage and ride inside the respective corresponding first channels 46 or second channels 48. As best seen in FIG. 3, the brace rollers 32 engage the back of the first rail 42, or the back of the second rail 44, to assist in counteracting a natural tendency of the elevator carriage 20 to pivot with respect to the drive pinions 66, and thereby assist in maintaining a relatively horizontal, level orientation of the elevator carriage 20.

The brace roller assembly 30 is relatively free to pivot with respect to the respective side panel 22 to assist the elevator carriage 20 to self-adjust to a relatively level orientation whenever adverse forces may act thereon, e.g., sudden motions from start or braking of the elevator carriage 20. Alternatively, the brace roller assembly 30 can be provided with other suitable structure to enable maintaining a relatively more positive control of the pivoting motion, such as a ratcheted or motorized pivot connection. As a further alternative embodiment, the proximal end of each first member 31 and second member 33 can be independently mounted to pivot with respect to the corresponding side panel 22. The rotatable connection of the brace rollers 32 can also be similarly constructed, as discussed, and can be rotatably mounted to the distal end of each of the first and second members 31, 33. Moreover, the material for the brace rollers 32 can be any of various suitable materials, such as plastic, rubber, elastomer, steel, wood, composites and combinations thereof. A solid rubber construction for the brace rollers 32, for example, can be used to enhance both resiliency and gripping capability.

Figures 5B, 6:
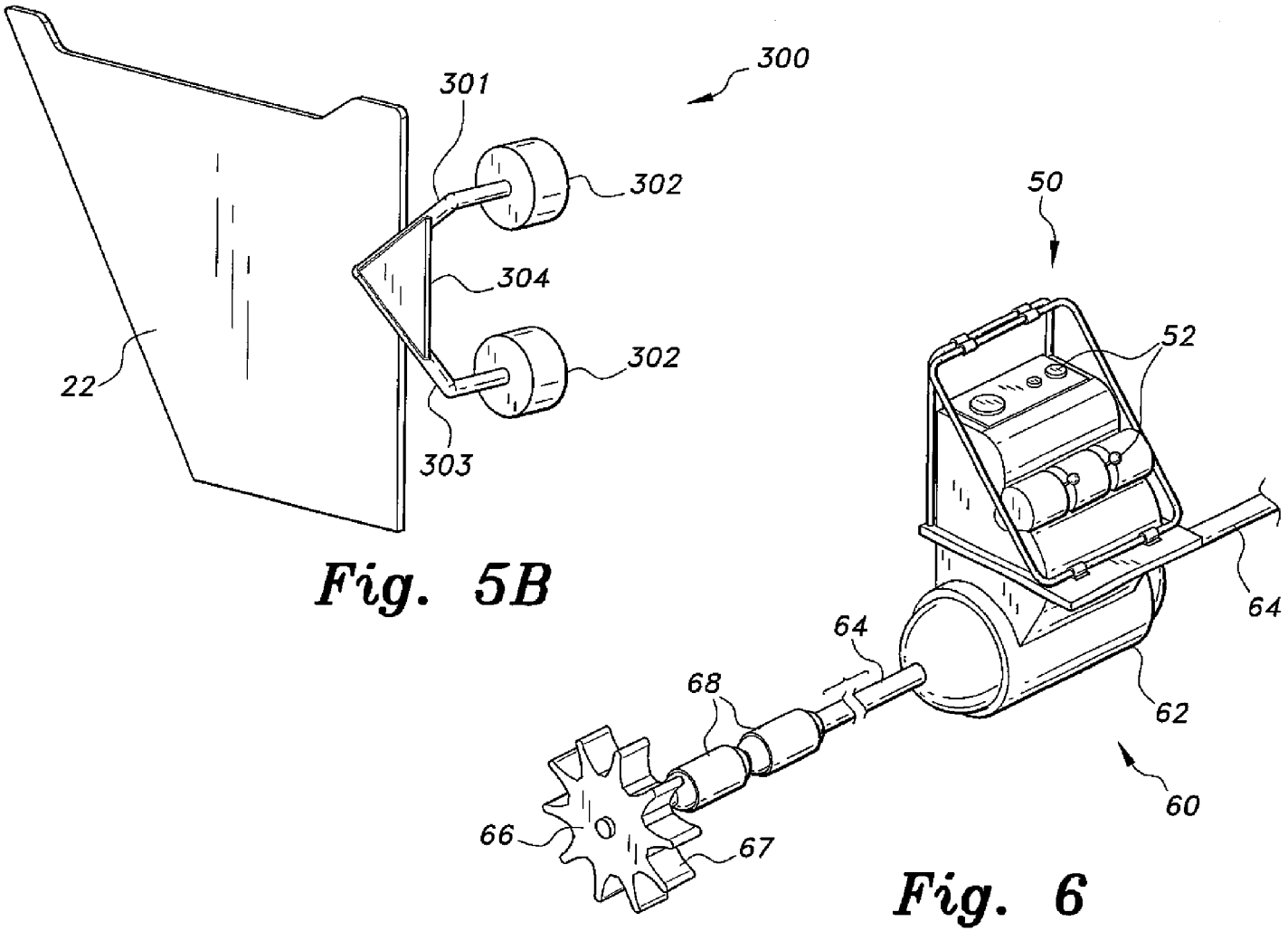
FIG. 5B is a perspective view of an alternative arrangement of the brace roller assembly for the external elevator shown in FIG. 2.
FIG. 6 is a perspective view of the power assembly for the external elevator carriage shown in FIG. 2.

An alternative embodiment of a brace roller assembly 300 is shown in FIG. 5B. In this alternative embodiment, the brace roller assembly 300 is exemplary of a reinforced open frame construction. As with the brace roller assembly 30 above, the brace roller assembly 300 includes a first member 301 angularly spaced from a second member 303 and a brace roller 302 rotatably mounted to the distal end of each first and second members 301, 303. To reinforce the open frame design, the brace roller assembly 300 also includes a triangular reinforcing plate 304 connected to both the first member 301 and the second member 303. The plate 304 can assist in strengthening and stiffening the frame. In another alternative embodiment, a truss assembly can be provided between the first member 31, 301 and the second member 31, 303 as another example of means for reinforcing the brace roller assembly 30, 300.

The power assembly 60 includes a motor 62 mounted to the bottom of the elevator carriage 20. As best seen in FIGS. 5A and 6, the motor 62 is disposed below the control console 50 and housed within a compartment 26 defined by the space between the floor panel 23 and the bottom panel 24. The floor panel 23 and/or the bottom panel 24 can be removable to allow access to the power assembly 60 for maintenance and the like. The motor 62 is typically a reversible motor to enable movement in the forward and reverse directions. An elongate drive shaft 64 extends from output ends of the motor 62. Each drive shaft 64 is preferably a flexible drive shaft to provide self-adjustable driving engagement of the pinions 66 with the corresponding pair of first rails 42 or second rails 44 to assist in counteracting adverse forces that may act on the elevator carriage 20 during use, and thereby also assist in maintaining traction. The power assembly 60 can also be provided with a constant velocity (CV) boot 68 between each set of drive shaft 64 and drive pinion 66. Alternatively, for example, each drive shaft 64 can be of non-flexible design. As best seen in FIG. 5A, notches can be formed at the lateral ends of the bottom panel 24 providing space for the drive pinions 66 and rotational movement thereof. Each drive pinion 66 includes a plurality of radiating drive teeth 67 for meshing with the teeth 43, 45 on the first and second rails 42, 44. Due to the stresses that can be experienced by the elevator carriage 20 during use, the mounting of the motor 62 and the drive shafts 64 are typically structurally reinforced.

As mentioned above, selective operation of the control console 50 raises or lowers the elevator carriage 20 along the pair of first rails 42 or second rails 44. The control console 50 includes a plurality of actuators to control various operations or accessories associated with the elevator carriage 20, such as a plurality of switches and/or buttons 52 for controlling the power state, speed of ascent or descent, and/or peripheral equipment. Normally, the elevator carriage 20 can be left or positioned at the top of the building B to display the advertisement 25 thereon to enhance maximizing exposure of the advertisement 25. When cleaning or maintenance is necessary, the elevator carriage 20 can be raised or lowered to select floors, and work can be performed on the windows and surfaces in relative safety. Unlike traditional platforms that utilize cable-wench systems, the elevator carriage 20 is relatively stably supported at both sides on a fixed rail, which typically is more resistant to adverse movement from weather and environmental forces, i.e. minimal swing. The elevator carriage 20 can also be used as an emergency evacuation vehicle. The relatively stable construction of the external elevator/advertising board system 10 can therefore provide a safer vehicle for moving residents or other personnel, within designed limits, with relatively minimal impact on safety concerns.

It is to be understood that the present invention is not limited to the embodiments described above, but encompasses any and all embodiments within the scope of the following claims.

I claim:

1. An external elevator/advertising board system for a building, comprising:

at least one elevator carriage, the elevator carriage having a bottom, side panels and an elongate front panel disposed at an acute angle with respect to the horizontal, the front panel having an advertisement displayed thereon;

wherein said elevator carriage comprises an open box frame, and the bottom of said at least one elevator carriage comprises an elongate floor panel and an elongate bottom panel disposed below the floor panel and defining a space therebetween, the space forming a compartment, said power assembly disposed within the compartment, said control console being mounted adjacent to said floor panel in operative connection with said power assembly;

a pair of brace roller assemblies pivotally mounted on the side panels of at least one elevator carriage, each of the brace roller assemblies having a pair of brace rollers;

wherein each said brace roller assembly comprises an angled, open frame having a radiating first member and a radiating second member angularly spaced with respect to each other;

at least one pair of track assemblies, each of the track assemblies being adapted for mounting to a side of the building;

a power assembly mounted adjacent to the bottom of the at least one elevator carriage, the power assembly drivingly engaging the at least one pair of track assemblies, each of the brace roller assemblies being disposed above the power assembly to substantially counteract pivoting of the elevator carriage; and a control console mounted to the at least one elevator carriage, the control console being operatively connected to the power assembly, wherein selective operation of the control console activates movement of the at least one elevator carriage along the at least one pair of track assemblies at a selected speed to a selected level on the corresponding side of the building.

2. The external elevator/advertising board system according to claim 1, wherein the brace rollers being rotatably mounted to a distal end of the first member and the second member.

3. The external elevator/advertising board system according to claim 2, further comprising a triangular plate disposed between said first member and said second member.

4. The external elevator/advertising board system according to claim 1, wherein each said track assembly comprises an elongate, L-shaped corner component having a pair of rails including an elongate first rail and an elongate second rail substantially orthogonal to the first rail, an elongate central base beam interconnecting the first rail and the second rail to each other, a first elongate channel disposed behind the first rail and extending substantially parallel to the first rail, and a second elongate channel disposed behind the second rail and extending substantially parallel to the second rail, said brace rollers riding in the first channel and the second channel, respectively.

5. The external elevator/advertising board system according to claim 4, wherein said first rail and said second rail each comprise an elongate rack having a plurality of teeth disposed thereon.

6. The external elevator/advertising board system according to claim 5, wherein said power assembly comprises:

a motor mounted to said control console, the motor having opposite output ends;

an elongate drive shaft extending from each of the output ends of the motor; and a drive gear rotatably mounted to a distal end of the drive shaft.

7. The external elevator/advertising board system according to claim 6, wherein said drive gear comprises a drive pinion, the drive pinion having a plurality of radiating drive teeth meshing with the corresponding rack during operation of said power assembly.

8. The external elevator/advertising board system according to claim 1, further comprising an elongate handrail mounted to at least one of said front panel and said side panels.

9. The external elevator/advertising board system according to claim 1, wherein said control console comprises at least one actuator, the at least one actuator controlling a power state and a rate of descent and ascent of said elevator carriage.

10. The external elevator/advertising board system according to claim 1, wherein said control console includes a plurality of actuators to selectively control one or more operations or accessories associated with the elevator carriage.

11. The external elevator/advertising board system according to claim 10, wherein the plurality of actuators selectively control one or more of a power state, a speed of ascent or descent, or peripheral equipment associated with the elevator carriage.

12. The external elevator/advertising board system according to claim 1, wherein the elevator carriage is used to evacuate the building in an emergency.

13. The external elevator/advertising board system according to claim 1, wherein the elevator carriage is used to clean or maintain the building.

14. The external elevator/advertising board system according to claim 1, wherein each said track assembly is adapted for mounting to a corner on a corresponding side of a building.

15. An advertising board system for use external elevator on a building, comprising:

at least one elevator carriage, the elevator carriage having a bottom, side panels and an elongate front panel disposed at an acute angle with respect to the horizontal, the front panel having an advertisement displayed thereon;

a pair of brace roller assemblies pivotally mounted on the side panels of at least one elevator carriage, each of the brace roller assemblies having a pair of brace rollers, each the brace roller assembly comprises an angled, open frame having a radiating first member and a radiating second member angularly spaced with respect to each other; the brace rollers being rotatably mounted to a distal end of the first member and the second member;

a triangular plate disposed between the first member and the second member;

at least one pair of track assemblies, each of the track assemblies being adapted for mounting to a side of the building;

a power assembly mounted adjacent to the bottom of the at least one elevator carriage, the power assembly drivingly engaging the at least one pair of track assemblies, each of the brace roller assemblies being disposed above the power assembly to substantially counteract pivoting of the elevator carriage; and a control console mounted to the at least one elevator carriage, the control console being operatively connected to the power assembly, wherein selective operation of the control console activates movement of the at least one elevator carriage along the at least one pair of track assemblies at a selected speed to a selected level on the corresponding side of the building.

16. The advertising board system for use external elevator on a building according to claim 15, further comprising an elongate handrail mounted to at least one of the front panel and the side panels;

wherein the control console comprises at least one actuator, the at least one actuator controlling a power state and a rate of descent and ascent of the elevator carriage, the control console includes a plurality of actuators to selectively control one or more operations or accessories associated with the elevator carriage, and the plurality of actuators selectively control one or more of a power state, a speed of ascent or descent, or peripheral equipment associated with the elevator carriage.

17. The advertising board system for use external elevator on a building according to claim 15, wherein each the track assembly includes an elongate, L-shaped corner component having a pair of rails including an elongate first rail and an elongate second rail substantially orthogonal to the first rail, an elongate central base beam interconnecting the first rail and the second rail to each other, a first elongate channel disposed behind the first rail and extending substantially parallel to the first rail, and a second elongate channel disposed behind the second rail and extending substantially parallel to the second rail, the brace rollers riding in the first channel and the second channel, respectively;

wherein the first rail and the second rail each comprise an elongate rack having a plurality of teeth disposed thereon;

the power assembly includes a motor mounted to the control console, the motor having opposite output ends, an elongate drive shaft extending from each of the output ends of the motor, and a drive gear rotatably mounted to a distal end of the drive shaft, the drive gear includes a drive pinion, the drive pinion having a plurality of radiating drive teeth meshing with the corresponding rack during operation of the power assembly.

18. A system for an advertising board carried on an external elevator of a building, comprising:

at least one elevator carriage, the elevator carriage having a bottom, side panels and an elongate front panel disposed at an acute angle with respect to the horizontal, the front panel having an advertisement displayed thereon;

a pair of brace roller assemblies pivotally mounted on the side panels of at least one elevator carriage, each of the brace roller assemblies having a pair of brace rollers;

at least one pair of track assemblies, each of the track assemblies being adapted for mounting to a side of the building;

a power assembly mounted adjacent to the bottom of the at least one elevator carriage, the power assembly including a motor mounted to the control console, the motor having opposite output ends, an elongate drive shaft extending from each of the output ends of the motor, and a drive gear rotatably mounted to a distal end of the drive shaft;

wherein the drive gear comprises a drive pinion, the drive pinion having a plurality of radiating drive teeth meshing with the corresponding rack during operation of the power assembly;

wherein the power assembly drivingly engaging the at least one pair of track assemblies, each of the brace roller assemblies being disposed above the power assembly to substantially counteract pivoting of the elevator carriage;

an elongate, L-shaped corner component having a pair of rails including an elongate first rail and an elongate second rail substantially orthogonal to the first rail, an elongate central base beam interconnecting the first rail and the second rail to each other, a first elongate channel disposed behind the first rail and extending substantially parallel to the first rail, and a second elongate channel disposed behind the second rail and extending substantially parallel to the second rail, the brace rollers riding in the first channel and the second channel, respectively;

wherein the first rail and the second rail each comprise an elongate rack having a plurality of teeth disposed thereon;

a control console mounted to the at least one elevator carriage, the control console being operatively connected to the power assembly;

wherein selective operation of the control console activates movement of the at least one elevator carriage along the at least one pair of track assemblies at a selected speed to a selected level on the corresponding side of the building; and an elongate handrail mounted to at least one of the front panel and the side panels.

19. The system for an advertising board carried on an external elevator of a building according to claim 18, wherein each one of the track assemblies is adapted for mounting to a corner on a corresponding side of a building.

20. The system for an advertising board carried on an external elevator of a building according to claim 18, wherein use of the elevator carriage is selected from the group consisting of evacuating the building in an emergency, and performing cleaning and maintenance of the building.

* * * * *